United States Patent [19]

Wu et al.

[11] Patent Number: 4,683,353

[45] Date of Patent: Jul. 28, 1987

[54] ROTARY SWITCH FOR INDUCTIVELY DRIVEN RAIL GUN SYSTEMS

[75] Inventors: Jiing-Liang Wu, Murrysville Boro; David W. Scherbarth, Wilkinsburg; David Marschik, Wilkins Township, Allegheny County, all of Pa.

[73] Assignee: Westinghouse Electric Corp., Pittsburgh, Pa.

[21] Appl. No.: 848,369

[22] Filed: Apr. 4, 1986

[51] Int. Cl.[4] ..... H01H 9/30; H01H 19/56; H01H 33/04; H01H 33/06

[52] U.S. Cl. ..... 200/8 R; 200/10; 200/144 R; 200/148 H; 200/150 C; 200/151

[58] Field of Search ..... 89/8; 200/8 R, 8 A, 200/10, 11 R, 11 A, 11 TC, 11 K, 144 R, 148 H, 150 C, 151

[56] References Cited

U.S. PATENT DOCUMENTS

| | | | |
|---|---|---|---|
| 2,908,789 | 10/1959 | Lange | 200/150 C |
| 4,369,692 | 1/1983 | Kemeny | 89/8 |
| 4,426,562 | 1/1984 | Kemeny | 200/151 |
| 4,429,613 | 2/1984 | Deis et al. | 89/8 |
| 4,433,607 | 2/1984 | Kemeny | 89/8 |
| 4,644,119 | 2/1987 | Wu | 200/144 R |

*Primary Examiner*—J. R. Scott
*Attorney, Agent, or Firm*—R. P. Lenart

[57] ABSTRACT

An electrical switch for switching direct current in an inductively driven electromagnetic projectile launching system is provided with a rotor having a generally cylindrical conductive element with a first portion that includes a continuously conductive external surface. A second portion of the conductive element includes a pair of insulating members fixed at angularly spaced locations such that sections of the conductive elements and the insulating members alternate along the generally cylindrical surface of the elememt. One pair of angularly spaced retractable brush members extend radially inward toward and axially along the conductive surface of the first portion of the conductive element to make sliding electrical contact with the conductive element during the inductor charging phase of a launch sequence. A second pair of angularly spaced retractable brush members extend radially toward the segmented portion of the rotor conductive element and serve to commutate current from the switch to a pair of generally parallel projectile launching rails. A switch housing encircles the rotor and supports conductors which are used to electrically connect one brush of each pair to the launcher circuit. The other brushes are electrically shorted. Means is provided for moving the brush members into and out of contact with the rotor conductive element to achieve the desired switching function.

23 Claims, 30 Drawing Figures

ROTARY SWITCH FOR INDUCTIVELY DRIVEN RAIL GUN SYSTEMS

BACKGROUND OF THE INVENTION

This invention relates to electric switches and more particularly to switches which are used to switch very large direct currents such as the currents required for electromagnetic projectile launching.

One well known type of electromagnetic projectile launcher includes a pair of generally parallel conductive rails, a sliding armature for conducting current between the rails and propelling a projectile along the rails, a source of direct current, and a switching system for commutating current from the current source to the projectile launching rails. Current sources which employ an inductive energy storage element and a homopolar generator have demonstrated the capability of providing sufficient current to achieve an acceptable projectile acceleration. However, such inductively driven launcher systems require the service of an opening switch to accomplish the required power compression. The functions performed by the opening switch include: providing, in the closed position, a low resistance path for current flowing during the charging of the inductive energy storage device; and commutating, within a short time interval of typically less than 1 millisecond, the current flowing into the conductive rail load. In repetitive firing launcher systems, these functions must be performed in rapid succession.

For practical launcher systems, the peak current that must be commutated is in the order of several hundred thousand to several million amperes, required commutation time is about 1 millisecond or less and the inductive energy store has an inductance of a few microhenries. If a low-voltage device such as a homopolar generator is used as a prime power supply for charging the inductive energy store, a charging time in the order of several tens to several hundreds of milliseconds is required. This produces a very high accumulated amp$^2$-second ($I^2t$) during the inductor charging phase, in the order of $10^{11}$ amp$^2$ second. The required performance parameters, that is, peak current, inductor charging time, accumulated $I^2t$ and commutation time, create conflicting demands on the switch design and are the critical factors to be considered.

To reduce the resistive loss in the switch to within an acceptable range for the above-mentioned current magnitude and its associated accumulated $I^2t$ and to be able to perform a repetitive switching function, a mechanical switch with multiple sliding metallic contacts is the preferred switch design. This type of switch conducts current through metal-to-metal interfaces between stationary and movable electrical contacts and can be designed to have a very low switch resistance, in the order of micro ohms or less, by increasing both the cross sectional area of the conductor and the number of contact points. However, this results in a massive movable contact which would inhibit the fast contact acceleration required to produce the rapidly rising arc voltage needed for current commutation.

One solution to this problem is illustrated in a copending, commonly assigned application Ser. No. 590,666, filed Mar. 19, 1984, and entitled "Repetitive Switch for Inductively Driven Electromagnetic Launchers", which is hereby incorporated by reference. That application illustrates a rotary switch which builds the movable contacts into a rotor that is rotated at a constant speed, thus not only eliminating the need to accelerate the contacts within a short duration but also achieving the repetitive switch open and close functions. The conflicting demands placed on the switch during inductor charging and while performing current commutation were satisfied by dividing the switch function between two parallel connected rotary switches which rotated at different speeds. The slow switch, which had massive contacts, was designed to conduct current during the inductor charging period and stays in the closed position until a few milliseconds before firing. At that time, the slow switch enters an open phase and commutates current into a fast switch. The fast switch, which was lighter and included a rotor rotating at a much higher speed, performed the current commutation into the load. Such a two switch system obviously requires close coupling between the fast switch rotor and the slow switch rotor to ensure the correct relationship between the conducting phase and the non-conducting phase so that the switches can perform their respective duties. Coordination of actuation between the sliding contacts of the two switches are also required. It is therefore desirable to provide an improved rotary switch design which performs all of the required switching functions in a single switch having a rotor rotating at a high speed. This would eliminate the need to connect two switches in parallel and provide a simple, more reliable switching system.

DESCRIPTION OF THE PREFERRED EMBODIMENT

The switches of the present invention are designed to provide both the inductor charging and current commutation operations required in an inductively driven electromagnetic projectile launching system. Switches constructed in accordance with this invention comprise a rotor having a generally cylindrical conductive element having a first portion which includes a continuously conductive external surface and a second portion to which insulating members are attached such that sections of the conductive element and the insulating members alternate along a generally cylindrical surface of the rotor. A first pair of angularly spaced retractable brush members extend radially inward toward and axially along the conductive external surface of the first portion of the conductive element, for making sliding electrical contact with the continuously conductive surface during inductor charging. A second pair of angularly spaced retractable brush members extend radially inward toward and axially along the generally cylindrical second portion of the conductive element, and provide the current commutation function. Means are provided for electrically connecting one brush of each brush pair to an external circuit, while the other brushes are electrically connected together. A switch housing encircles the rotor and means for rotating the rotor with respect to the housing is provided.

When the switching function is to be performed, the first pair of brushes are actuated to make sliding contact with the continuously conductive cylindrical portion of the rotor conductive element during charging of the launching system inductive energy store. When the desired inductor current level has been reached, the second pair of brushes are actuated to make electrical contact with the second portion of the rotor conductive element. Then the first pair of brushes are retracted so that all of the current flows through the second pair of brushes and the rotor conductive element. As the rotor continues to rotate, the insulating members on the second portion of the rotor conductive element pass under the brushes of the second pair thereby interrupting the flow of current between these brushes and producing a voltage which commutates current into the projectile launching rails of the system.

By appropriately dimensioning and positioning the elements of the switch, the length of the current path within the switch can be reduced to lower the switch inductance, unbalanced forces on the switch rotor can be reduced, and electromagnetic forces can be utilzed to assist in holding the brushes in contact with the rotor conductive element surface. One preferred embodiment of the present invention uses a symmetrical switch design in which two rotor conductive elements are axially aligned and longitudinally spaced along a single rotor and additional brush pairs are positioned to make contact with the second rotor conductive element.

DESCRIPTION OF THE PREFERRED EMBODIMENTS

Figure 1:
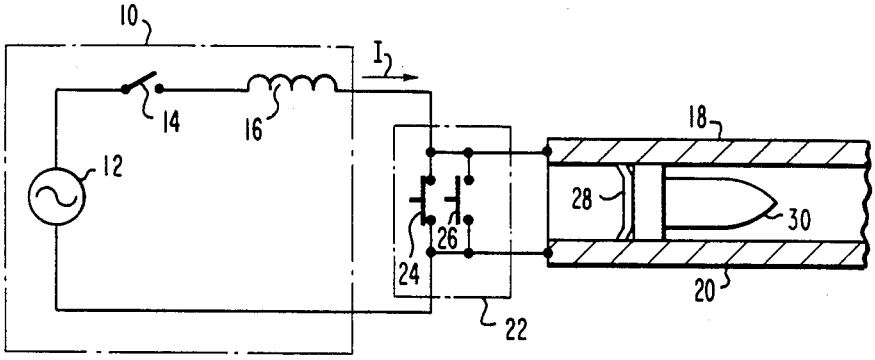
FIG. 1 is a schematic diagram of an electromagnetic projectile launching system which includes a switch constructed in accordance with the present invention.

Referring to the drawings, FIG. 1 is a schematic diagram of an inductively driven electromagnetic projectile launching system which includes the switch of the present invention. A power supply 10 which includes the series connection of a homopolar generator 12, switch 14 and inductive energy storage device 16 is electrically connected to a pair of generally parallel projectile launching rails 18 and 20. A switch assembly 22 is connected across the breech end of the launching rails and includes a pair of internally parallel connected switches 24 and 26. During operation, switches 14 and 24 are initially closed and inductor 16 begins to charge. When a desired inductor current is reached, switch 26 is closed and switch 24 is subsequently opened, thereby transferring the inductor current into switch 26. Shortly thereafter, switch 26 opens and commutates the inductor current into the launcher rails 18 and 20 thereby causing current to flow in the sliding conductive armature 28 and propelling the projectile 30 along the rails.

Figure 2:
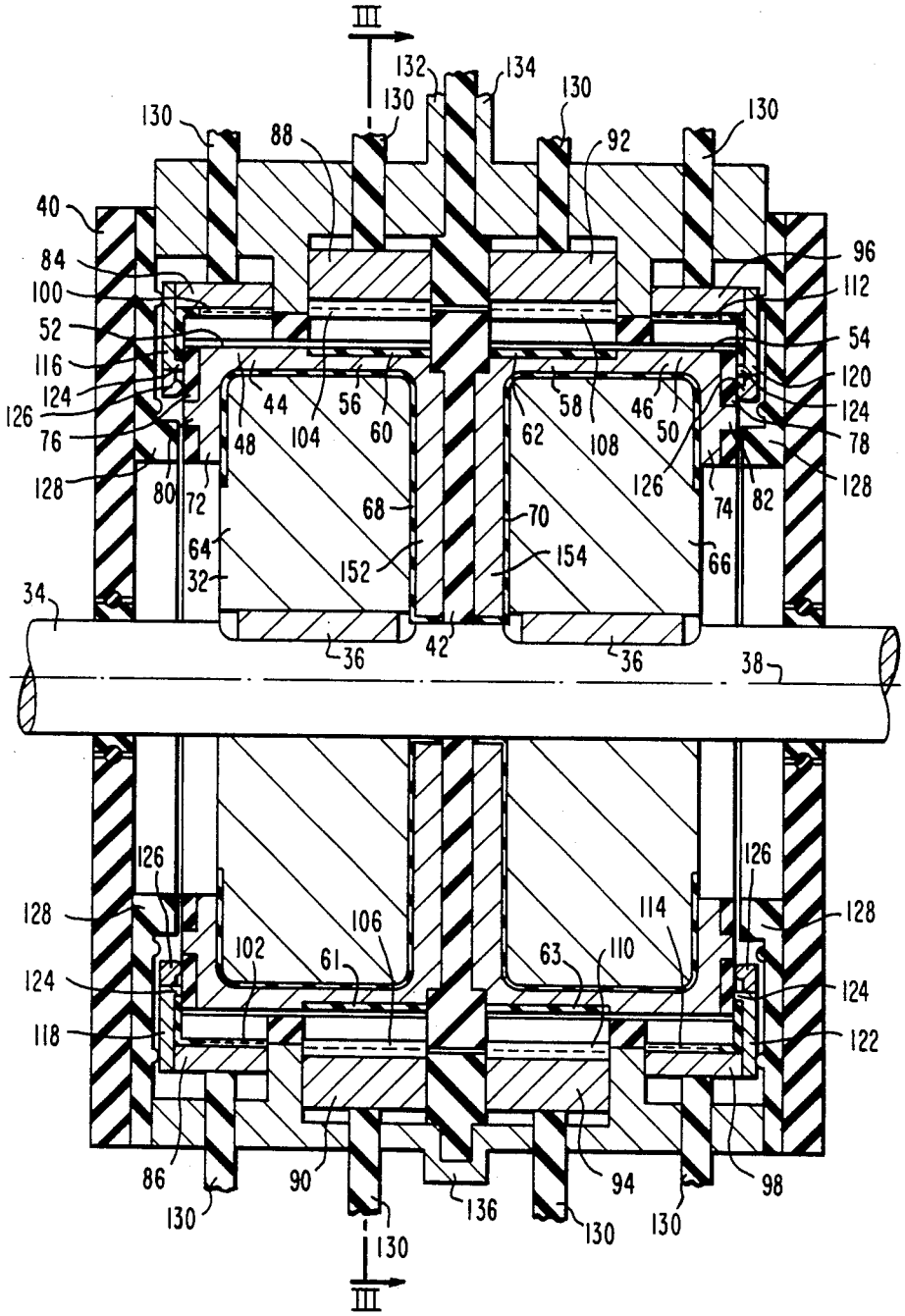
FIG. 2 is a cross section of a switch constructed in accordance with one embodiment of the present invention.

FIG. 2 is a cross section of a switch constructed in accordance with one embodiment of this invention. In FIG. 2, a rotor 32 is shown to be mounted on shaft 34 and keyed by way of key elements 36 to rotate about a central axis 38 with the shaft. The rotor and shaft assembly is mounted for rotation with respect to a stationary switch housing 40. A mid-plane insulating element 42 extends radially from the shaft 34 and divides the rotor into two symmetrical sections. Each of these rotor sections includes a rotor conductive element 44 and 46. Each of these rotor conductive elements includes a first portion 48 and 50 respectively having a continuously conductive external cylindrical surface 52 and 54, respectively. Each of these rotor conductive elements also includes a second portion, 56 and 58 respectively to which fixed insulating members 60, 61, 62 and 63 have been attached to provide two segmented rotor surfaces which include alternating insulating members and portions of the conductive elements 44 and 46. The rotor conductive elements are mounted on non-magnetic support structures 64 and 66 and insulated from these support structures by a layer of insulation 68 and 70 which may be, for example, glass reinforced polyester.

Circular flanges 72 and 74 extend radially inward from the ends of each of the rotor conductive elements. Rings of insulating materials 76 and 78 are positioned along the end faces of the rotor conductive elements and serve to define conducting ring surfaces 80 and 82 on opposite ends of the rotor. A plurality of retractable switch brush members 84, 86, 88, 90, 92, 94, 96 and 98 are disposed within the switch housing and are normally withdrawn from contact with the rotor surface. Each of these brush members includes a plurality of resilient contacts 100, 102, 104, 106, 108, 110, 112 and 114, which are positioned to make sliding electrical contact with the surfaces of the rotor conductive elements 44 and 46. Brush members 84, 86, 96 and 98 also include side contact plates 116, 118, 120 and 122 which extend radially inward along the sides of the rotor and include multiple transfer contact fingers 124 for making electrical contact with rings 80 and 82 on the rotor. The side conductor plates and transfer contact fingers are made of highly conductive and high tensile strength material such as chrome-copper. Arc resistant contact tips 126 which may be, for example, copper-tungsten, are brazed onto the ends of the contact fingers. Stationary insulating material structures 128 extend from the switch housing to points adjacent to ends of the rotor to form arcing chambers which enclose the contact fingers. The inner surfaces of these insulating material structures adjacent to the transfer contact fingers are contoured in such a way that when the contact fingers are moved radially inward, the arcing tips are wedged between the rotor side surface and the insulating structure, thus preventing the contact fingers from being blown off the rotor side surface by elecromagnetic forces.

During switch operation, the brush members are moved in a radial direction by means of an insulated actuating rods 130. Brush members 88, 90, 92 and 94 are designed to operate as in the rotary switch disclosed in application Ser. No. 590,666, as discussed above. Bus bars 132 and 134 serve as means for electrically connecting certain ones of the brush members to an external circuit. Bush bar 136 serves as means for shorting other ones of the brush members together.

Figure 3:
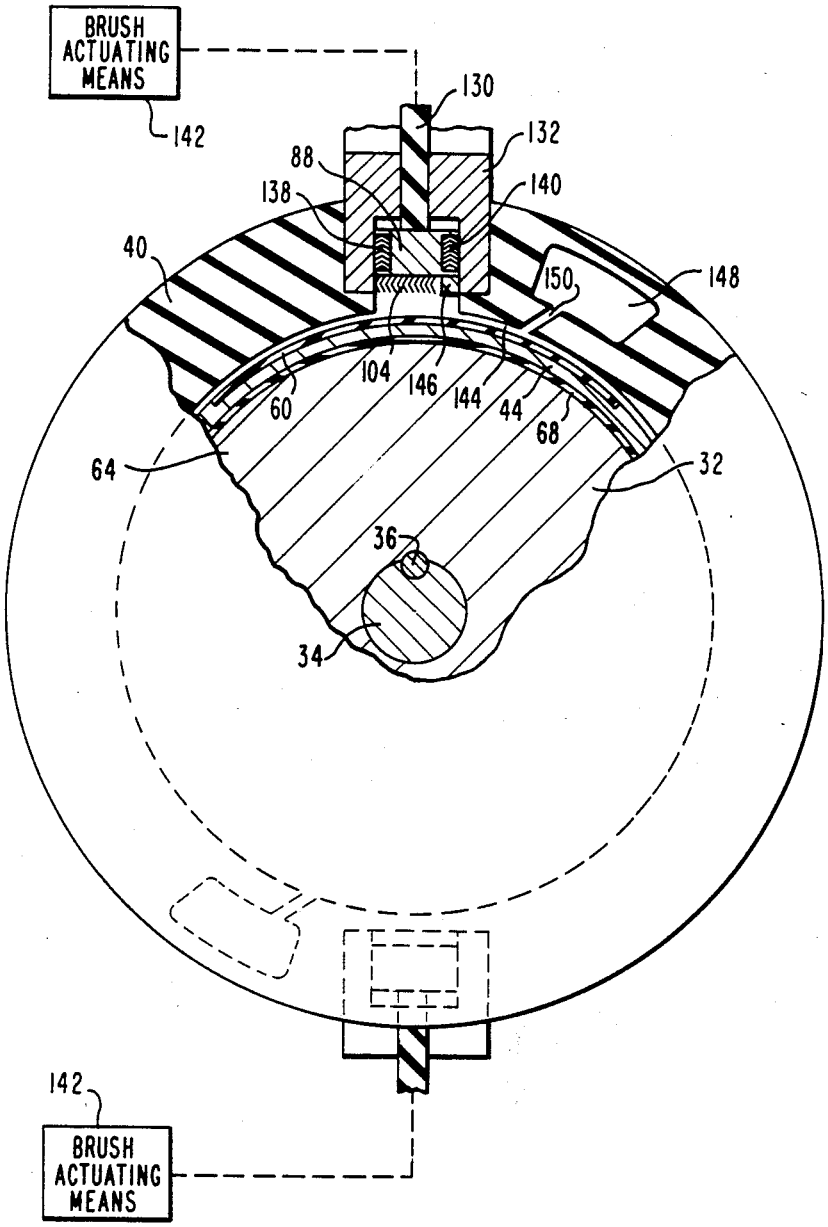
FIG. 3 is a partial cross section of the switch of FIG. 2 taken along line III—III.

FIG. 3 is a partial cross section of the switch of FIG. 2 taken along line III—III. In this view, resilient contact elements 104 are shown to be generally chevron-shaped in a radial cross section. Additional resilient contact members 138 and 140 are positioned along the sides of brush member 88 to make sliding electrical contact with bus bar 132. Brush actuating means 142 is used to provide the required mechanical force on rods 130 to move the brush members radially into and out of contact with the surface of the rotor conductive element. The switch housing 40 and surface of the rotor form an arcuate arc gap 144 to contain an arc which will be drawn from arc resistant contact 146 on brush member 88 when the insulating member 60 on the rotor 32 passes under the brush member. An additional arc member 148 is shown to be connected to this arcuate arc gap 144 by means of an opening 150 in the switch housing.

Figure 4:
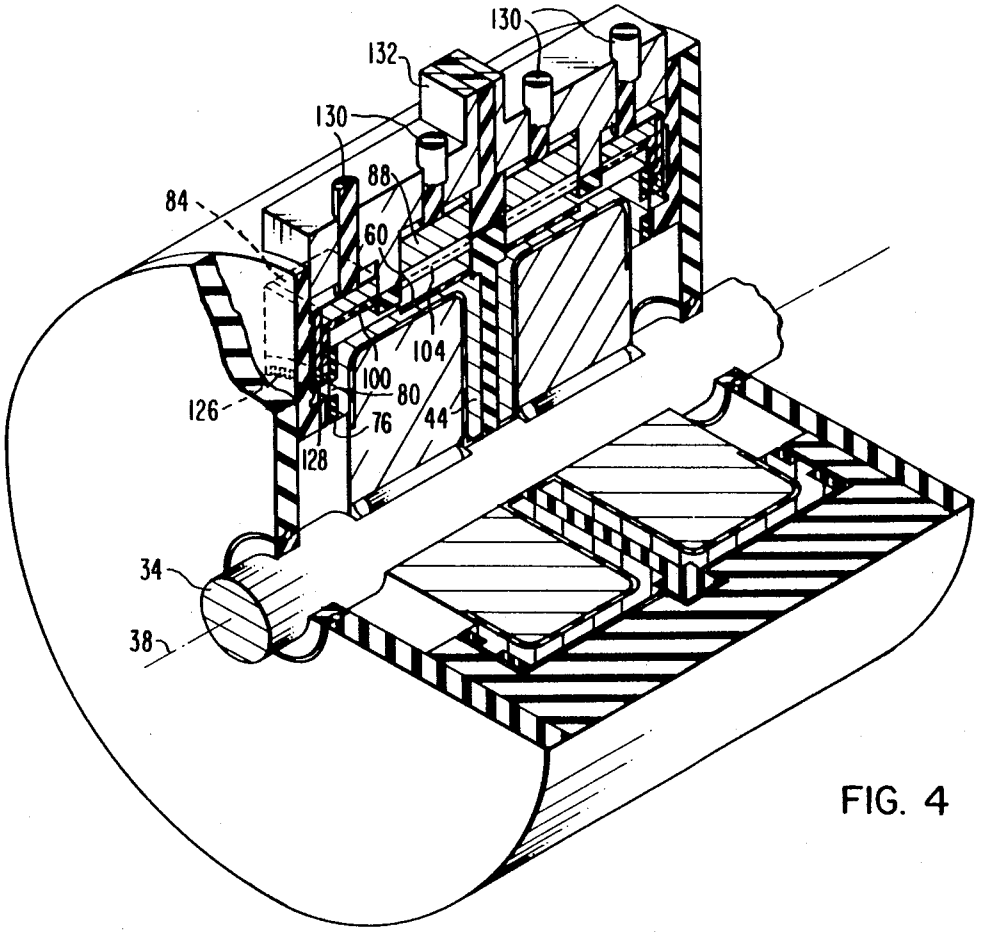
FIG. 4 is an isometric view, partially in section, of the switch of FIGS. 2 and 3.

FIG. 4 is an isometric view, partially in section, of the switch of FIG. 2. This view is included to illustrate the manner in which the retractable brush members are associated with the adjacent bus bar 132.

Figure 5:
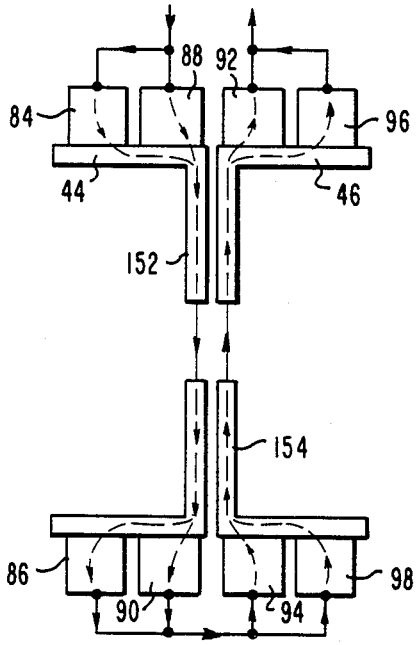
FIG. 5 is a schematic representation which illustrates the current flow in the switch of FIG. 2.

FIG. 5 is a schematic representation of the switch of FIG. 2 which illustrates the initial current flow pattern when all of the brushes are making sliding contact with the rotor conductive elements 44 and 46. Note that a pair of disks 152 and 154 extend diametrically across one end of each of the rotor conductive elements and conduct current essentially radially across the rotor conductive elements. In this schematic, the conductors within the switch assembly housing are illustrated as wires and the current directions are illustrated by arrows.

Figure 6:
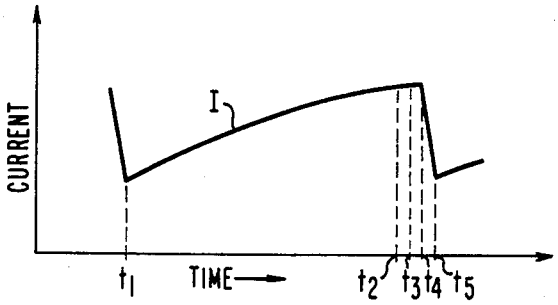
FIG. 6 is a curve which illustrates the current flow in the launching system of FIG. 1.
Figure 7A:
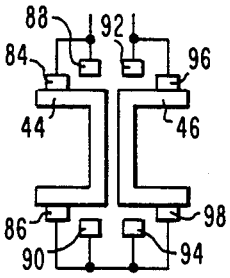
FIGS. 7A–7J are schematic diagrams which illustrate the operation of the switch of FIG. 2.
Figure 7B:
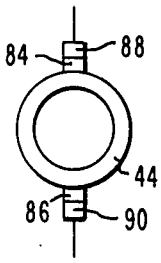
Figure 7C:
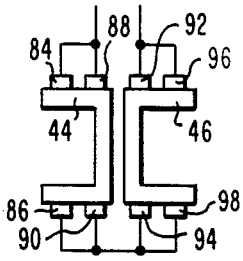
Figure 7D:
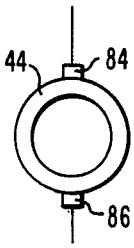
Figure 7E:
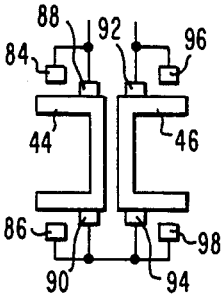
Figure 7F:
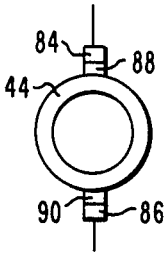
Figure 7G:
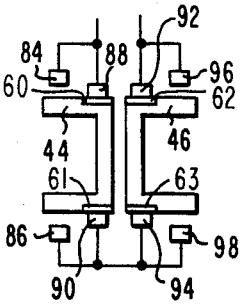
Figure 7H:
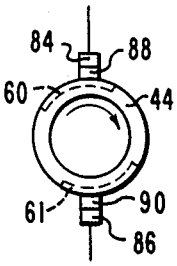
Figure 7I:
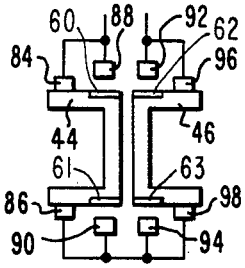
Figure 7J:
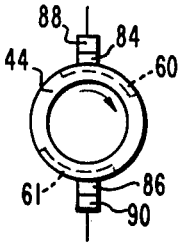

FIG. 6 is a curve which illustrates the flow of current I in the electromagnetic projectile launching system of FIG. 1. This figure can be used in conjunction with the schematic diagrams of FIG. 7 to explain the operation of the present invention switches. FIGS. 7A and 7B illustrate the brush member positions between time $t_1$ and $t_2$. During the time interval, brush members 84, 86, 96 and 98 which are hereinafter referred to as charging brushes, making sliding electrical contact with the rotor conductive elements while brush members 88, 90, 92 and 94, which are hereinafter referred to as commutating brushes, are spaced away from the rotor. Since the charging brushes make contact with the continuously conducting cylindrical surface of the rotor elements at this time, rotor angular position is not relevant and many revolutions of the rotor may be made during this phase. FIGS. 7C and 7D represent the precommutation period between times $t_2$ and $t_3$ in FIG. 6. During this time interval, the commutation brushes are lowered onto the rotor and the rotor angular position is still not relevant. FIGS. 7E and 7F represent the internal current transfer stage between time $t_3$ and $t_4$ wherein the charging brushes are raised, thereby transferring current into the commutation brushes. When this occurs, the commutating brushes must be on a conducting section of the segmented portion of the rotor conducting elements. FIGS. 7G and 7H represent the brush member positions during the commutation and post-commutating time period between times $t_4$ and $t_5$. Note that the brush positions are the same as in FIGS. 7E and 7F. However, the insulating segments 60 and 61 have passed beneath brush members 88 and 90 and insulating segments 62 and 63 have passed beneath brush members 92 and 94, to interrupt the flow of current between these brushes. At this time, a commutating voltage is generated by a series of four arcs within the switch. FIGS. 7I and 7J represent the brush member positions during reclosing following time $t_5$ in FIG. 6. Here the charging brushes are lowered onto the rotor conducting element and the commutating brushes have been lifted. The lowering of the charging brushes would occur after the projectile leaves the barrel and the commutating brushes would be lifted while they are still on the insulating segments of the rotor.

Figure 8:
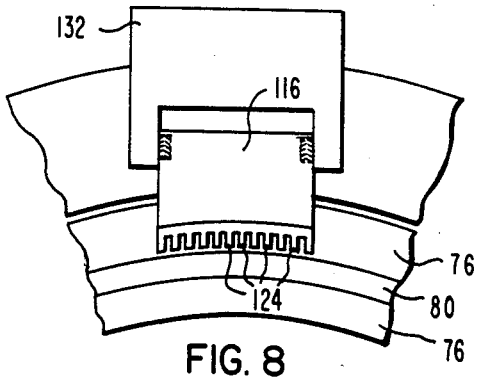
FIGS. 8 and 9 illustrate one of the contact brush members of the switch of FIG. 2.
Figure 9:
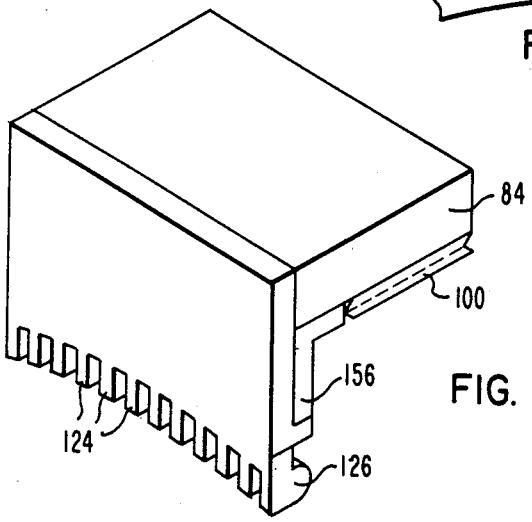

FIGS. 8 and 9 are included to more clearly illustrate the construction of one of the end brush members. In these views, contact fingers 124 and one of the arc-resistant contact tips 126 are clearly illustrated. Furthermore, an insulator 156 is shown to be positioned between the resilient contact elements 100 and the contact fingers 124.

Figure 10:
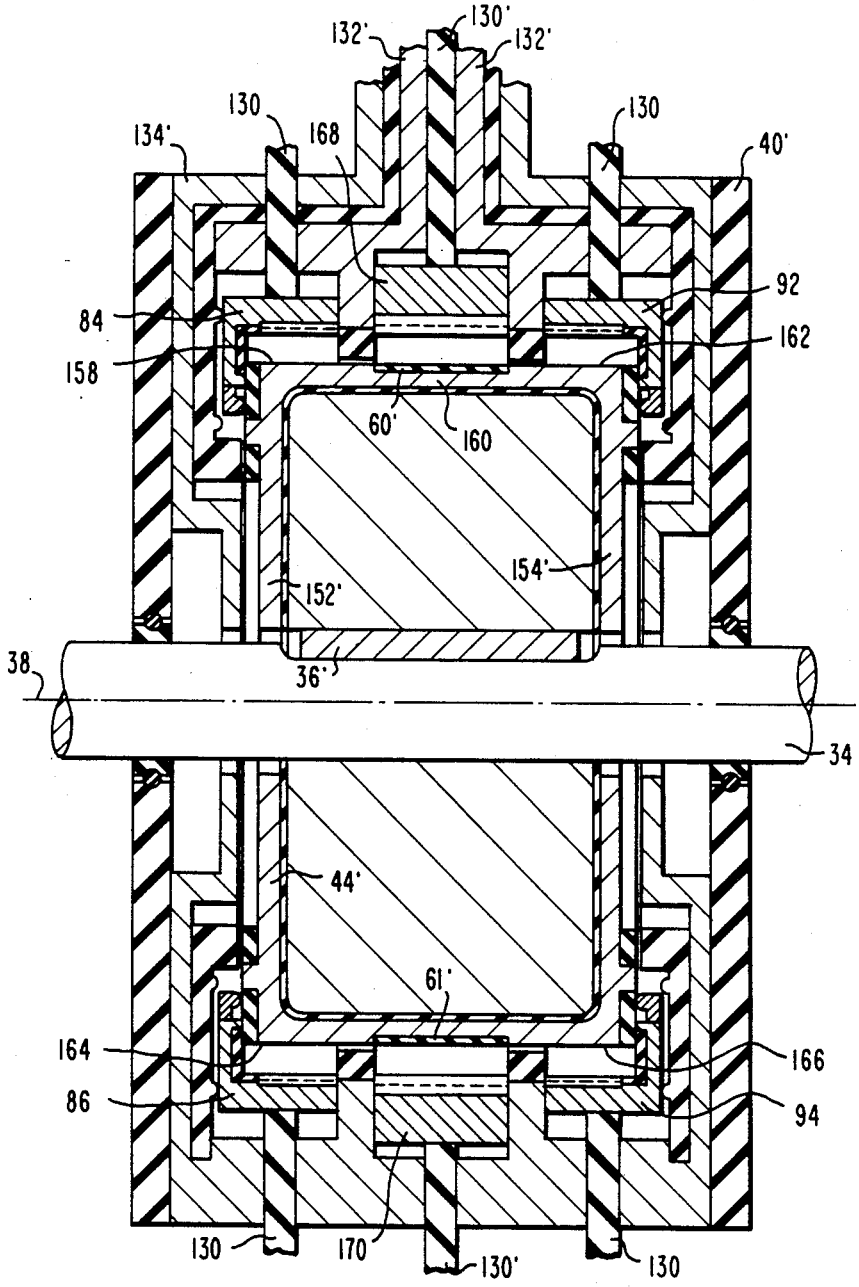
FIG. 10 is a cross section of an alternative embodiment of the switch of the present invention.
Figure 12A:
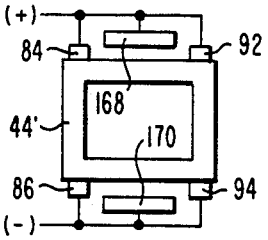
FIGS. 12A–12J are schematic diagrams which illustrate the operation of the switch of FIG. 10.
Figure 12B:
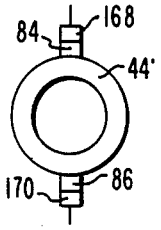
Figure 12C:
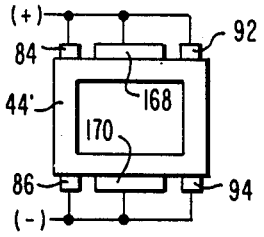
Figure 12D:
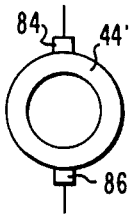
Figure 12E:
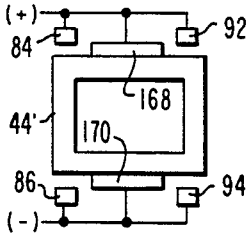
Figure 12F:
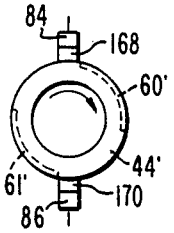
Figure 12G:
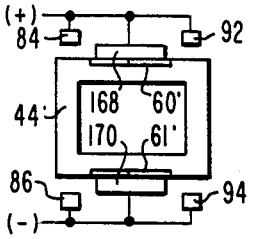
Figure 12H:
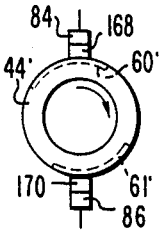
Figure 12I:
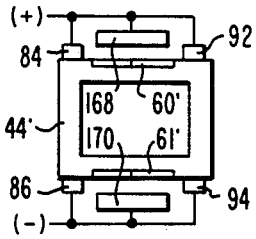
Figure 12J:
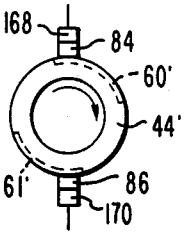

FIG. 10 is a cross section of an alternative embodiment of a switch constructed in accordance with this invention. In this figure, elements which are identical to those of the switch of FIG. 2 are identified by identical numbers while elements which perform the same function as elements of the switch of FIG. 2 are designated by primed numbers. In this embodiment, the rotor conductive element includes three portions 158, 160 and 162. Portions 158 and 162 include continuously conducting outside cylindrical surfaces 164 and 166, while portion 160 represents a segmented cylindrical portion wherein the outside surface alternately includes portions of the conductive element 44' and insulating members 60' and 61'. Bus bars 132' serve to electrically connect brushes 84, 92 and 168 to an external circuit while bus bar 134' serves to electrically short brushes 86, 94 and 170 and also serves to connect these brushes to an external circuit.

Figure 11:
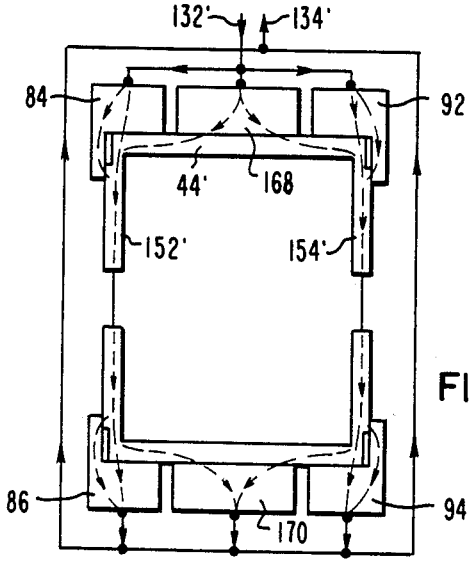
FIG. 11 is a schematic diagram which illustrates the current flow in the switch of FIG. 10.

FIG. 11 is a schematic diagram which illustrates the current flow within the switch of FIG. 10 when all of the brushes are in contact with the conductive rotor cylindrical element 44'. As in FIG. 5, the conductors within the switch assembly housing 40' are shown as wires and the current directions are illustrated by arrows. The switch of FIG. 10 provides two sets of charging contacts and one set of commutating contacts which produces two arcs in series. This results in a lower arc voltage than would be produced by the switch of FIG. 2 and hence slower current commutation. However, the switch of FIG. 10 provides more surface area for the commutating contacts which results in higher $I^2t$ capability. The switch of FIG. 10 also provides lower inductance than the switch of FIG. 2.

The schematic diagrams of FIG. 12 can now be used in conjunction with the current waveform of FIG. 6 to describe the operation of the switch of FIG. 10. FIGS. 12A and 12B represent the brush positions during the charging period between times $t_1$ and $t_2$. In this time interval, the charging brushes 84, 86, 96 and 98 make sliding electrical contact with the rotor conductive element 44' while the commutating brushes 168 and 170 are off of the rotor. The rotor angular position is not relevant and many revolutions may be made during this phase. FIGS. 12C and 12D represent the brush positions during the precommutation time interval between times $t_2$ and $t_3$. In this time interval, the commutation brushes are lowered onto the rotor and the rotor annular position is still not relevant. FIGS. 12E and 12F represent the internal current transfer phase wherein the charging brushes are raised, thus transferring current to the commutating brushes. The commutating brushes must be on a conducting section of the segmented portion of the rotor conductive element. FIGS. 12G and 12H represent the commutation time interval between times $t_4$ and $t_5$. During this interval, the brushes remain in the same positions as for the internal current transfer phase, however, insulating segments on the second portion of the rotor conductive element have passed beneath the commutating brushes and commutating voltage is produced by two arcs in series. FIGS. 12I and 12J represent post-shot switch closure following time $t_5$ wherein the charging brushes are lowered and the commutating brushes are lifted. The lowering of the charging brushes occurs following the exit of the projectile from the barrel and the commutating brushes are lifted while they are still on the insulating segments.

The transfer of current from the stator bus bars in the switch housing to the retractable brush members in the switches of this invention is arranged such that electromagnetic forces acting on the charging brush members are minimized while net forces for keeping the brush members in a closed position are applied to the commutating brush members. The current path within the rotor is symmetrical and unbalanced electromagnetic forces are minimal.

In both of the switch embodiments illustrated, in the normal operating condition, the rotor is stationary and all sliding brush members are withdrawn from the surface of the rotor. At the desired moment prior to firing of the electromagnetic launcher, the rotor is spun up by, for example, connection to an external electric motor, to a desired speed which would yield the required rotor circumferential speed corresponding to the contact separation and arc lengthening speed needed for commutating current into the launcher load. When the primary energy storage source such as the homopolar generator is ready to discharge its energy into the inductive energy storage device, the charging brush members are actuated to the closed position and a current flow is established through the switch. The current path is arranged such that a moderate repulsion force results on the charging brush members and therefore an external mechanical force is needed to keep these brush members in a closed position. A sharing of current occurs between the multi-leaf resilient contact elements and the transfer contact fingers. The ratio of this current division can be designed to suit the desired switch performance requirements. Since the external surface of the rotor conductive element which is in contact with the charging brush members is continuously conducting, current can be conducted through the switch as long as these brush members are in the closed position. This means that the inductor charging time is controlled by the actuation and de-actuation of the charging brush members and the rotor can be spun at any desired speed.

At a desired instant, for example less than 10 milliseconds prior to launcher firing, the commutating brush members are actuated to the closed position and shortly thereafter charging brush members are withdrawn to the open position. The timing of actuation of these two groups of contacts are coordinated so that separation of the transfer contact fingers of the charging brush members from the conductive rings on the ends of the rotor does not occur until the conducting segments on the segmented portion of the rotor come in phase with the commutating brush members. By lifting the charging brush members first, current is forced to initially flow through the transfer contact fingers, since due to contact overlap, the transfer contact fingers carry current when the resilient contact elements of the charging brush members break with the rotor circumference. At this time, a small portion of the current also flows through the commutating brush members. Later, all of the current is transferred to the commutating brush members when sufficient arc voltage is developed in the region of the transfer contact fingers. The path of current flow at this instant in the stator bus bars and the commutating brush elements is such as to provide a positive contact closing force on the commutating brush members due to electromagnetic interaction. This force increases as a square of the current, thus providing a means to keep the commutating brush members in the closed position even at ultra-high current levels. Once current is commutated into the load, the electromagnetic force is reduced to zero, allowing the commutating brush members to be lifted. Because of the small inductance associated with the short and compact current paths during the transfer of current from the charging brush members to the commutating brush members, and because a relatively long transfer time of one of three milliseconds is acceptable, the voltage required to be generated at the transfer contact finger regions is quite moderate. A contact opening speed, that is a speed required to withdraw the charging contacts, of a few meters per second, should be sufficient.

Although the present invention has been described in terms of what are at present are believed to its preferred embodiments, it should be understood that various modifications may be made without departing from the scope of the invention. For example, only one half of the switch of FIG. 2 may be employed thereby using only brush members 84 and 86 as the charging brushes and brush members 88 and 90 as the commutating brushes. This would result in the use of two arcs in series to produce the voltage needed to commutate current to the load. The return current path of this variation can be arranged to flow through the stationary switch housing. A second variation, which entirely eliminates all arcing between the multi-leaf resilient contact elements of the charging brush members and the all-conductive rotor surface, is to dispose the multi-leaf resilient contact elements of the charging brush members in the same plane as the transfer contact fingers, that is, conducting all current through the rotor end surface. The configuration of the transfer contact fingers and the resilient contact elements in these variations would of course require the former to be last in parting contact with the rotor end surface. This variation may require a larger rotor end surface to be used for current conduction. However, the required rotor length would obviously be reduced.

The switches of this invention are designed to perform functions which previously would have required two separate switches. This not only simplifies the switching system but also increase reliability of the system. The current flow paths through the described preferred embodiments of this invention are symmetrical, thus minimizing the unbalanced electromagnetic forces on the switch rotor and switch housing. Allowing current to return through the switch rotor as in the FIG. 2 embodiment greatly minimizes the unbalanced axial load on the rotor which reduces the capacity requirement of the rotor bearings. This arrangement of the current flow path also reduces loop inductance during commutation of current into the load. By positioning the commutating brush members and stator bus bars as illustrated, electromagnetic forces generated by the current can be used to keep the commutating brush members in sliding contact in the closed position, thereby reducing the force which must be applied by the actuator mechanism. Since the electromagnetic force increases as the square of the current magnitude, it can be employed to satisfy the requirement of higher contact force for higher current. Because of the short and closely spaced current loops produced by the illustrated shape of the charging brush members, current transfer from the resilient contact elements to the transfer contact fingers should produce only minimal arcing. This arcing can be entirely eliminated by disposing the resilient contact elements in the same plane as the transfer contact fingers.

What is claimed is:

1. A switch for switching direct current comprising:
a rotor having a generally cylindrical conductive element;
said conductive element having first and second portions, wherein said first portion includes a continuously conductive external surface;
a pair of insulating members fixed at angularly spaced locations on said second portion such that sections of said conductive element and said insulating members alternate along a generally cylindrical surface of said second portion;
a first pair of angularly spaced retractable brush members extending radially inward toward and axially along the conductive external surface of the first portion of the conductive element, for making sliding electrical contact with said first portion of the conductive element;
a second pair of angularly spaced retractable brush members extending radially inward toward and axially along the generally cylindrical surface of the second portion of the conductive element;
means for electrically connecting a first one of said first pair of brush members and a first one of said second pair of brush members to an external circuit;
means for electrically connecting a second one of said first pair of brush members to a second one of said second pair of brush members;
a switch housing encircling said rotor;
means for rotating the rotor with respect to said housing;
means for moving each of said brush members from a first portion, wherein the brush members do not make electrical contact with said conductive element, to a second position, wherein the brush members make electrical contact with said conductive element; and
said second pair of brush members and said conductive element being so dimensioned and positioned such that with said rotor in a first position, applied current flows from said first one of said second pair of brush members through said conductive element to said second one of said second pair of brush members, and with said rotor rotated to a second position, said conductive element no longer makes contact with both of said second pair of brush members, thereby interrupting the flow of current between the brush members of said second pair of brush members.

2. A switch as recited in claim 1, wherein each of said retractable brush members comprises:
a first set of resilient contact elements extending from an inward surface of each brush member for making electrical contact with said rotor conducting element; and
a second set of resilient contact elements extending from a side of each brush member for making sliding electrical contact with a bus bar positioned adjacent to said side of each brush member.

3. A switch as recited in claim 1, wherein said switch housing forms a generally cylindrical opening for receiving said rotor, such that a generally annular gap is formed between the rotor and the switch housing, a portion of said gap defining a first internal arc chamber.

4. A switch as recited in claim 3, further comprising:
a second arc chamber connected to said first arc chamber through an opening in said switch housing.

5. A switch as recited in claim 1, wherein said conductive element further includes:
a disk portion connected to said second portion and extending diametrically across said conductive element.

6. A switch as recited in claim 1, further comprising:
an insulating ring attached to a first end of said first portion of said conductive element; and
a conductive flange electrically connected to said first end of said first portion of said conductive element and extending radially inward from said insulating ring to form a conductive ring on an end surface of said rotor.

7. A switch as recited in claim 6, wherein each of said first pair of brush members comprises:
a plurality of arc resistant contact fingers for making sliding electrical contact with said conductive ring.

8. A switch for switching direct current comprising:
a rotor having two generally cylindrical conductive elements;
each of said conductive elements having first and second portions, wherein each of said first portions includes a continuously conductive external surface;
a pair of insulating members fixed at angularly spaced locations to each of said second portions such that sections of each of said conductive elements and said insulating members alternate along a generally cylindrical surface of each of said second portions;
a first set of angularly spaced retractable brush members extending radially inward toward and axially along the conductive external surface of each of the first portions of the conductive elements, for making sliding electrical contact with said first portions of the conductive elements;
a second set of angularly spaced retractable brush members extending radially inward toward and axially along the generally cylindrical surface of the second portion of each of the conductive elements;
means for electrically connecting selected brush members of said first set and selected brush members of said second set to an external circuit;
means for electrically connecting certain brush members of said first set to certain brush members of said second set;
a switch housing encircling said rotor;
means for rotating the rotor with respect to said housing;
means for moving each of said brush members from a first position, wherein said brush members do not make electrical contact with one of said conductive elements, to a second position, wherein said brush members make electrical contact with one of said conductive elements; and
said second set of brush members and said conducting elements being so dimensioned and positioned such that with said rotor in a first position, applied current flows from said selected brush members of said second set of brush members through said conducting elements to said certain brush members of said second set of brush members, and with said rotor rotated to a second position, said conducting elements no longer make contact with each of said second set of brush members, thereby interrupting the flow of current between the brush members of said second set of brush members.

9. A switch as recited in claim 8, wherein each of said retractable brush members comprises:

a first set of resilient contact elements extending from an inward surface of each brush member for making electrical contact with one of said rotor conducting elements; and a second set of resilient contact elements extending from a side of each brush member for making sliding electrical contact with a bus bar positioned adjacent to said side of each brush member.

10. A switch as recited in claim 8, wherein said switch housing forms a generally cylindrical opening for receiving said rotor, such that a generally annular gap is formed between the rotor and the switch housing, a portion of said gap defining a first arc chamber.

11. A switch as recited in claim 10, further comprising:

a second arc chamber connected to said first arc chamber through an opening in said switch housing.

12. A switch as recited in claim 8, wherein said second portions of said conductive elements are positioned adjacent to each other.

13. A switch as recited in claim 8, wherein said rotor further includes:

a pair of disk portions each connected to one of said second portions and extending diametrically across one of said conductive elements.

14. A switch as recited in claim 8, further comprising:

a pair of insulating rings each attached to a first end of one of said portions of one of said conductive elements; and a pair of conductive flanges each electrically connected to said first end of one of said first portions of said conductive elements and extending radially inward from one of said insulating rings to form a conductive ring on each end surface of said rotor.

15. A switch a recited in claim 8, wherein each of said first set of brush members further comprises:

a plurality of arc resistant contact fingers for making sliding electrical contact with one of said conductive rings.

16. A switch for switching direct current comprising:

a rotor having a generally cylindrical conductive element;

said conductive element having first, second and third portions, wherein said first and third portions each include a continuously conductive external surface;

a pair of insulating members fixed at angularly spaced locations to said second portion such that sections of said conductive element and said insulating members alternate along a generally cylindrical surface of said second portion;

a first set of angularly spaced retractable brush members extending radially inward toward and axially along the conductive external surface of the first and third portions of the conductive element, for making sliding electrical contact with said first and third portions of the conductive element;

a second set of angularly spaced retractable brush members extending radially inward toward and axially along the generally cylindrical surface of the second portion of the conductive element;

means for electrically connecting a first two of said first set of brush members and a first one of said second set of brush members to an external circuit;

means for electrically connecting a second two of said first set of brush members to a second one of said second set of brush members;

a switch housing encircling said rotor;

means for rotating the rotor with respect to said housing;

means for moving each of said brush members from a first position, wherein said brush members do not make electrical contact with said conductive element, to a second position, wherein said brush members make electrical contact with said conductive element; and said second set of brush members and said conductive element being so dimensioned and positioned such that with said rotor in a first position, applied current flows from said first one of said second set of brush members through said conductive element to said second one of said second set of brush members, and with said rotor rotated to a second position, said conductive element no longer makes contact with both of said second set of brush members, thereby interrupting the flow of current between the brush members of said second set of brush members.

17. A switch as recited in claim 16, wherein each of said retractable brush members comprises:

a first set of resilient contact elements extending from an inward surface of each brush member for making electrical contact with said rotor conductive element; and a second set of resilient contact elements extending from a side of each brush member for making sliding electrical contact with a bus bar positioned adjacent to said side of each brush member.

18. A switch as recited in claim 16, wherein said switch housing forms a generally cylindrical opening for receiving said rotor, such that a generally annular gap is formed between the rotor and the switch housing, a portion of said gap defining a first internal arc chamber.

19. A switch as recited in claim 18, further comprising:

a second arc chamber connected to said first arc chamber through an opening in said switch housing.

20. A switch as recited in claim 16, wherein said second portion of said conductive element lies axially between said first and third portions.

21. A switch as recited in claim 16, wherein said conductive element further includes:

a pair of disk portions each electrically connected to an opposite end of said conductive element and extending diametrically across said conductive element.

22. A switch as recited in claim 21, further comprising:

an insulating ring attached to an end surface of each of said disks adjacent to a peripheral surface of each of said disks.

23. A switch as recited in claim 21, wherein each of said first set of brush members further comprises:

a pluality of arc resistant contact fingers for making sliding electrical contact with one of said disks.

* * * * *